US010729927B2

(12) United States Patent
Henesey

(10) Patent No.: US 10,729,927 B2
(45) **Date of Patent: *Aug. 4, 2020**

(54) EXERCISE APPARATUS

(71) Applicant: Brian P. Henesey, Lansdale, PA (US)

(72) Inventor: Brian P. Henesey, Lansdale, PA (US)

( * ) Notice: Subject to any disclaimer, the term of this patent is extended or adjusted under 35 U.S.C. 154(b) by 42 days.

This patent is subject to a terminal disclaimer.

(21) Appl. No.: 16/125,221

(22) Filed: Sep. 7, 2018

(65) Prior Publication Data

US 2019/0070450 A1 Mar. 7, 2019

Related U.S. Application Data

(60) Provisional application No. 62/555,322, filed on Sep. 7, 2017.

(51) Int. Cl.

| | |
|---|---|
| ***A63B 21/062*** | (2006.01) |
| ***A63B 23/04*** | (2006.01) |
| ***A63B 21/00*** | (2006.01) |
| ***A63B 21/055*** | (2006.01) |

(52) U.S. Cl.

CPC ..... *A63B 21/0626* (2015.10); *A63B 21/0552* (2013.01); *A63B 21/4033* (2015.10); *A63B 23/0405* (2013.01); *A63B 2023/0411* (2013.01)

(58) Field of Classification Search

CPC ..... A63B 21/0626; A63B 23/0405; A63B 21/0552; A63B 21/4033; A63B 2023/0411

USPC ..... 482/97

See application file for complete search history.

(56) References Cited

U.S. PATENT DOCUMENTS

| | | | | |
|---|---|---|---|---|
| 87,465 | A * | 3/1869 | Butler | A63B 21/154 482/94 |
| 4,589,658 | A * | 5/1986 | Gibson | A63B 21/4001 482/105 |
| 4,674,160 | A * | 6/1987 | Gibson | A63B 21/06 482/139 |
| 8,961,375 | B2 | 2/2015 | Henesey | |
| D755,908 | S | 5/2016 | James | |
| 9,744,404 | B2 | 8/2017 | Shiao et al. | |
| 2010/0285935 | A1 | 11/2010 | Barnett | |
| 2012/0220432 | A1 | 8/2012 | Henesey | |
| 2012/0316041 | A1* | 12/2012 | Meister | A63B 23/0494 482/140 |

OTHER PUBLICATIONS

International Search Report and Written Opinion dated Dec. 31, 2018 in the corresponding International Application No. PCT/US2018/050034.

* cited by examiner

*Primary Examiner* — Loan B Jimenez
*Assistant Examiner* — Andrew M Kobylarz
(74) *Attorney, Agent, or Firm* — Stroock & Stroock & Lavan LLP

(57) ABSTRACT

An exercise apparatus is provided for use with a hip belt or short bar for respectively conducting squat or dead lift exercises, comprising at least one elevated platform secured to a rack, a weight holder, and a guide rod and/or other guide. The weight holder may be designed to hold free weights and to attach onto a hip belt or short bar. As the user performs the desired exercise supported by the platform, the guide rod and/or other guide; guides the weight holder as it is lowered into the hole, limiting movement of the weight holder in the horizontal direction.

16 Claims, 9 Drawing Sheets

FIG. 4A
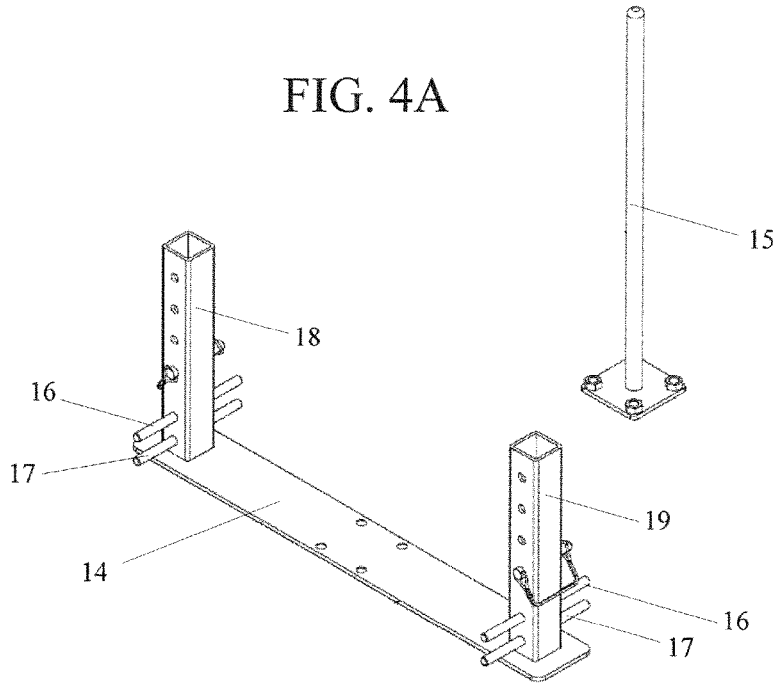
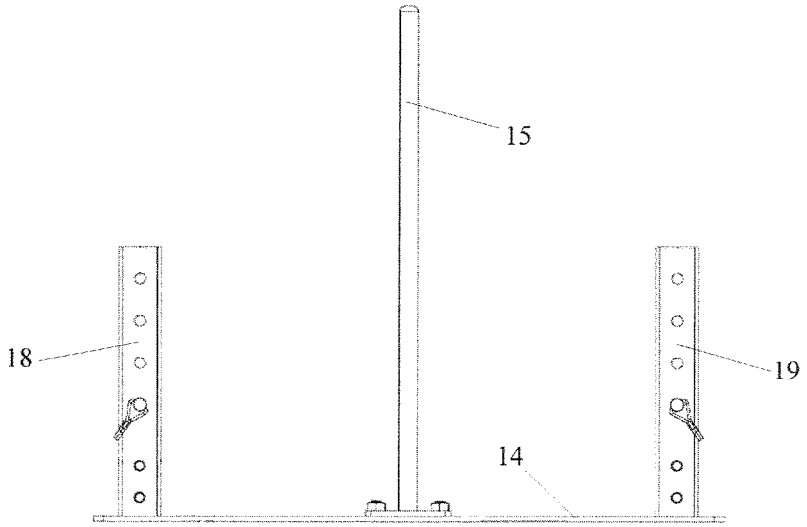
FIG. 4B
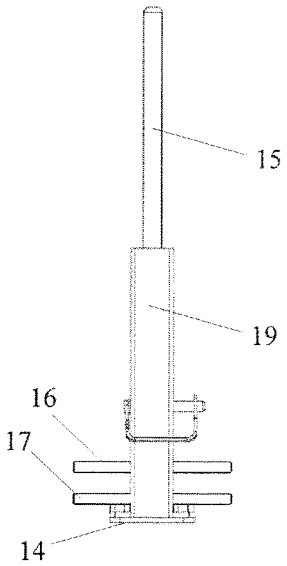
FIG. 4C

EXERCISE APPARATUS

CROSS REFERENCE TO RELATED APPLICATIONS

The present application claims priority to and the benefit of the filing date of U.S. Provisional No. 62/555,322, filed Sep. 7, 2017, which application is incorporated herein fully by this reference.

FIELD OF INVENTION

The present invention relates generally to an exercise apparatus and, more specifically, to a squat and deadlift exercise apparatus for use with a rack.

BACKGROUND OF THE INVENTION

The free weight deadlift exercise is typically performed with a weighted barbell, where the loaded barbell is placed on the floor out in front of the lifter's shins. The deadlift is well known to be a beneficial strength training exercise and is used extensively by athletes. However, because the weighted barbell is located out in front of the lifter, there is spinal flexion which can be dangerous for individuals who are susceptible to shear and compression of the spine. Also, because of where the bar sits, it requires a certain degree of technical mastery in order to limit the risk of a spine and lower back injuries. The lifter must ensure that the barbell remains pulled against the legs as it is lifted up to waist height. A perfect deadlift is considered one where the barbell scrapes against the lifter's shins and thighs, often leading to scraping and bruising. Thus, there exists a need for an improved apparatus for performing deadlifts.

The squat exercise, which is typically performed with a weighted barbell on the athlete's shoulders, is recognized as a highly beneficial strength training exercise. However, weighted barbell squats can be dangerous, especially for individuals who are susceptible to spinal compression injuries and shoulder impingement. Consequently, squats using weights supported by hip belts have been proposed. The current modes for performing the squat exercise with a hip belt involve either unstabilized free weights (e.g., U.S. Pat. No. 4,589,658) or a pulley system (e.g., U.S. Pat. No. 5,158,520). These modes have proven subpar both from a safety perspective and a performance perspective. Although U.S. Pat. No. 8,961,375 B2 reflects a substantial improvement over such prior belt squat devices, improvements related thereto are desired and have been made.

SUMMARY

Embodiments of the present invention include apparata for performing squats and/or deadlift exercises, in the case of deadlifts, using a unique shorter in length bar attachment, and in the case of squats, preferably using a hip belt such as is disclosed in U.S. Pat. No. 8,961,375 B2 (hereby incorporated herein by reference). Certain embodiments of the exercise apparatus are intended for use with a custom rack or existing squat or power rack (versions also referred to as a Smith Machine; such equipment collectively referred to herein as a rack) having at least two side supports. One such embodiment includes a single platform, a weight holder, and a guide rod. The platform is sized to support both feet of the user, includes a hole sized for the weight holder to pass through between the user's feet, spans the distance between the side supports of the rack and is configured to (preferably, releasably) secure to the rack's side supports. The platform may be supported by one, two, or more legs, with connection to the rack providing stability. At least a portion of the guide rod is positioned beneath the platform and is aligned with the center of the hole. The weight holder has a hollow loading pin sized to receive the guide rod. When the user performs the exercise, the weight holder is raised and/or lowered through the platform hole, guided by the guide rod as the weight holder is moved relative to the guide rod and beneath the elevated platform. Additionally, the exercise apparatus may also include two movable arms, each extending above the platform and each of the movable arms being coupled to a different loading arm. One such embodiment intended for use during deadlift exercises also includes a bar (preferably sized to fit between the user's legs while performing the deadlift) coupled to the weight holder. A further embodiment intended for use during squat exercises also includes a weight belt coupled to the weight holder.

In alternate embodiments of the invention that are intended for use with a rack having two side supports, the apparatus includes two platforms, a guide rod, and a weight holder. The two platforms are each sized to support a user's foot and configured to (preferably, releasably) secure to a different one of the rack's side supports, the platforms having a space therebetween. The platforms may be fully supported by the side supports (e.g., fully elevated from the ground) or partially supported (e.g., each platform also have a support for resting on the floor). At least a portion of the guide rod is positioned beneath the platforms and between the platforms. The guide rod is aligned with the space between the platforms. The weight holder has a hollow loading pin sized to receive the guide rod. When the user performs the exercise the weight holder is raised and/or lowered, guided by the guide rod as the weight holder is moved relative to the guide rod and beneath the elevated platform. Additionally, the exercise apparatus may also include two movable arms, each extending above a different one of the platforms, and each of the movable arms being coupled to a different loading arm. An embodiment intended for use during deadlift exercises also includes a bar (preferably sized to fit between the user's legs while performing the deadlift) coupled to the weight holder. A further embodiment intended for use during squat exercises also includes a weight belt coupled to the weight holder.

In certain embodiments, the apparatus also includes a center brace. The guide rod is attached to the center brace. The center brace may be attached to the platform or platforms by posts or legs.

In other embodiments, other means for guiding the weights/weight holder may be used, such as resistance bands below the platform or platforms. In certain embodiments both the guide rod and resistance bands are used, while in other embodiments, only bands are used with no guide post. The resistance bands may be secured to the apparatus by any of a number of ways, including for example, by being attached to pegs connected to the apparatus below the platform or platforms. The weight holder may also include pegs for the resistance bands to attach.

Some embodiments may not include the guide rod and utilize other means for guiding the weights, such as resistance bands located below the platform or platforms and connected to the weight holder.

BRIEF DESCRIPTION OF THE DRAWINGS

The drawings correspond to embodiments of the invention. The figures are merely illustrative and do not limit the invention as claimed. In the drawings:

FIG. 4A is a top perspective view of a guide rod and a center brace of an embodiment of the apparatus before the guide rod is attached to the center brace.

FIG. 4B is a front view of the guide rod and center brace of FIG. 4A after the guide rod is attached to the center brace.

FIG. 4C is a side view of the guide rod and center brace of FIG. 4A after the guide rod is attached to the center brace.

DETAILED DESCRIPTION OF CERTAIN EMBODIMENTS OF THE INVENTION

Figure 1A:
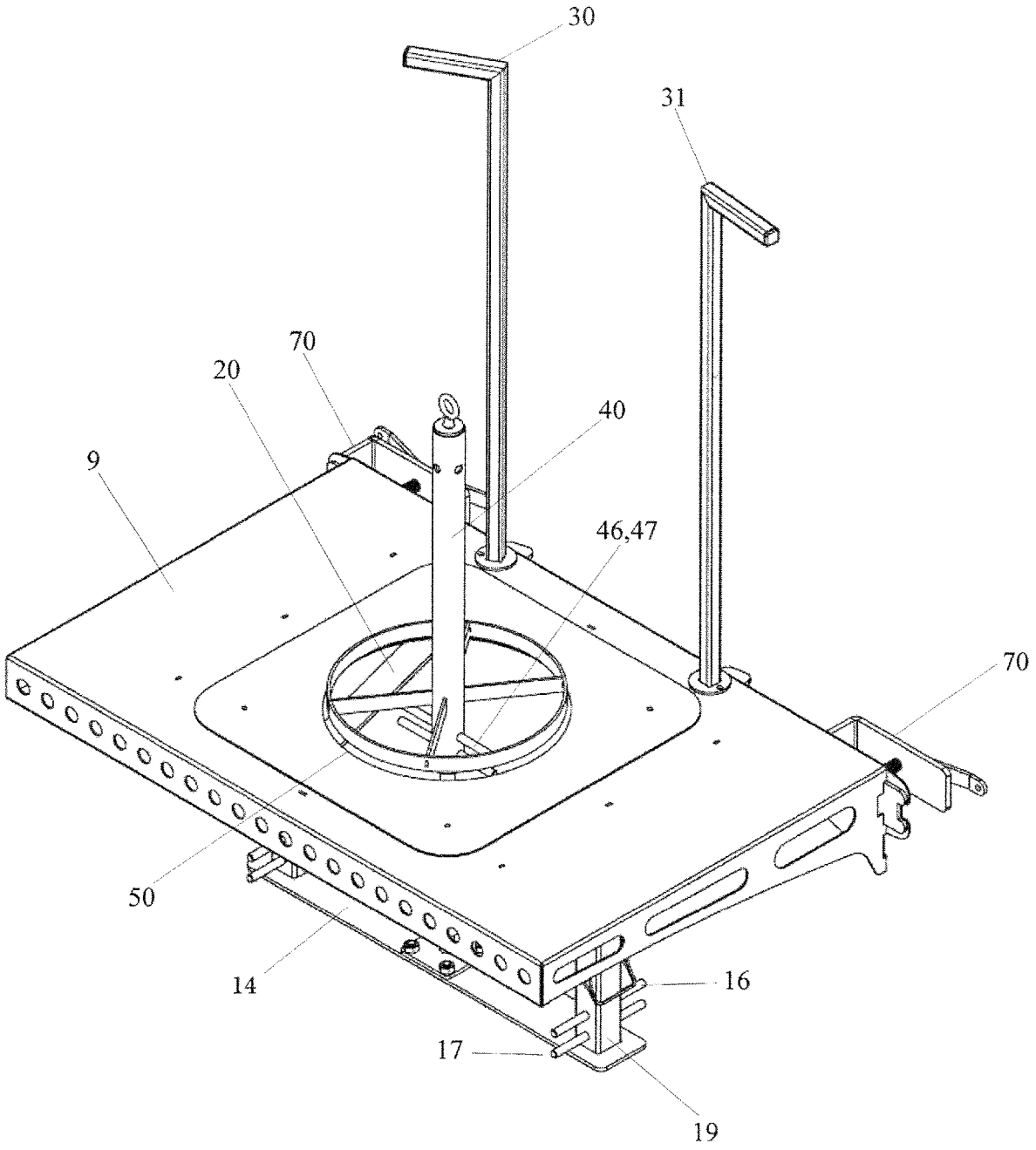
FIG. 1A is a perspective view an embodiment of the apparatus having a single platform before being attached to a rack and with one loading arm in the loading position.
Figure 1B:
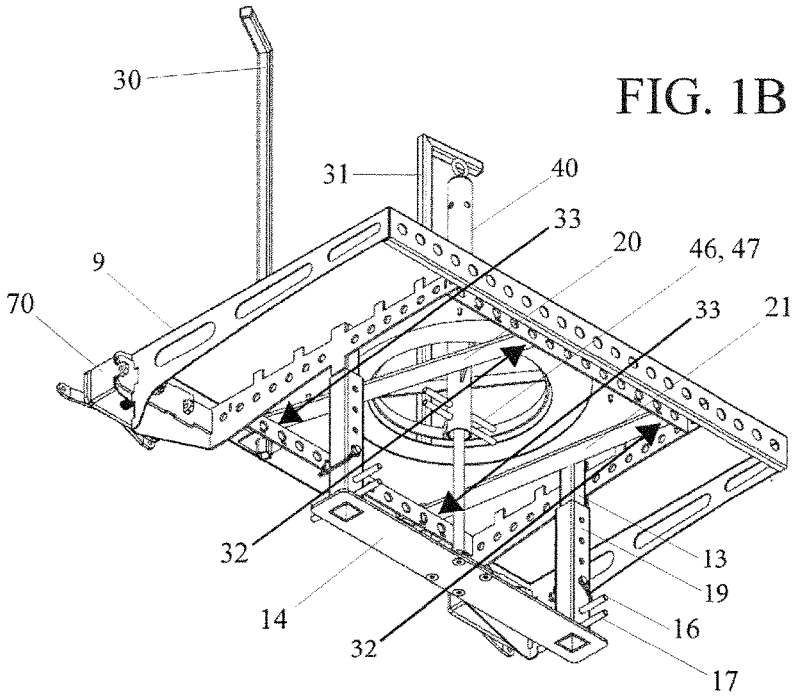
FIG. 1B is a bottom perspective view of the apparatus of the embodiment in FIG. 1A.
Figure 1C:
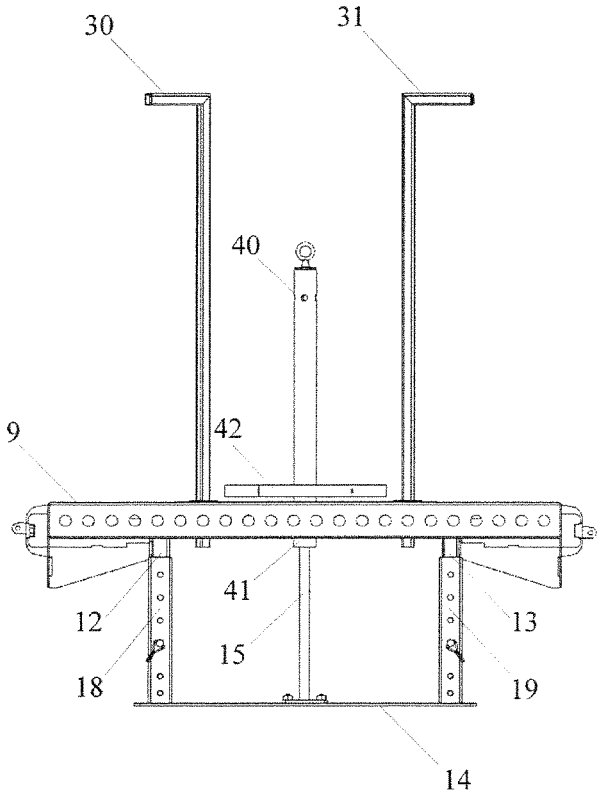
FIG. 1C is a front view of the apparatus of the embodiment of FIG. 1A.
Figure 1D:
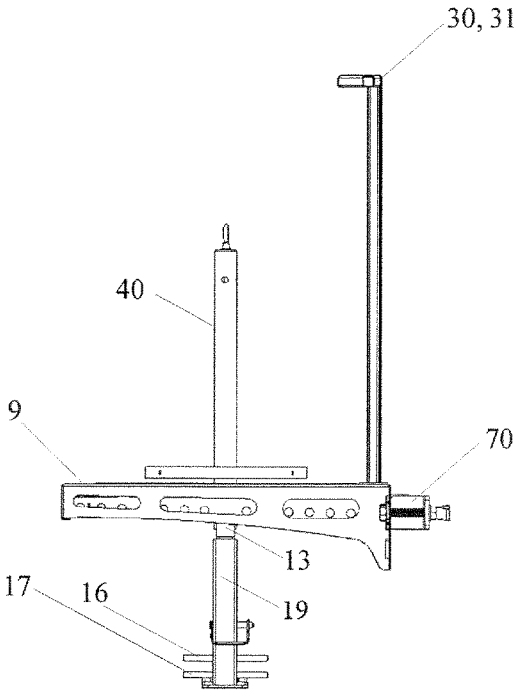
FIG. 1D is a left side view of the apparatus of the embodiment of FIG. 1A.
Figure 2:
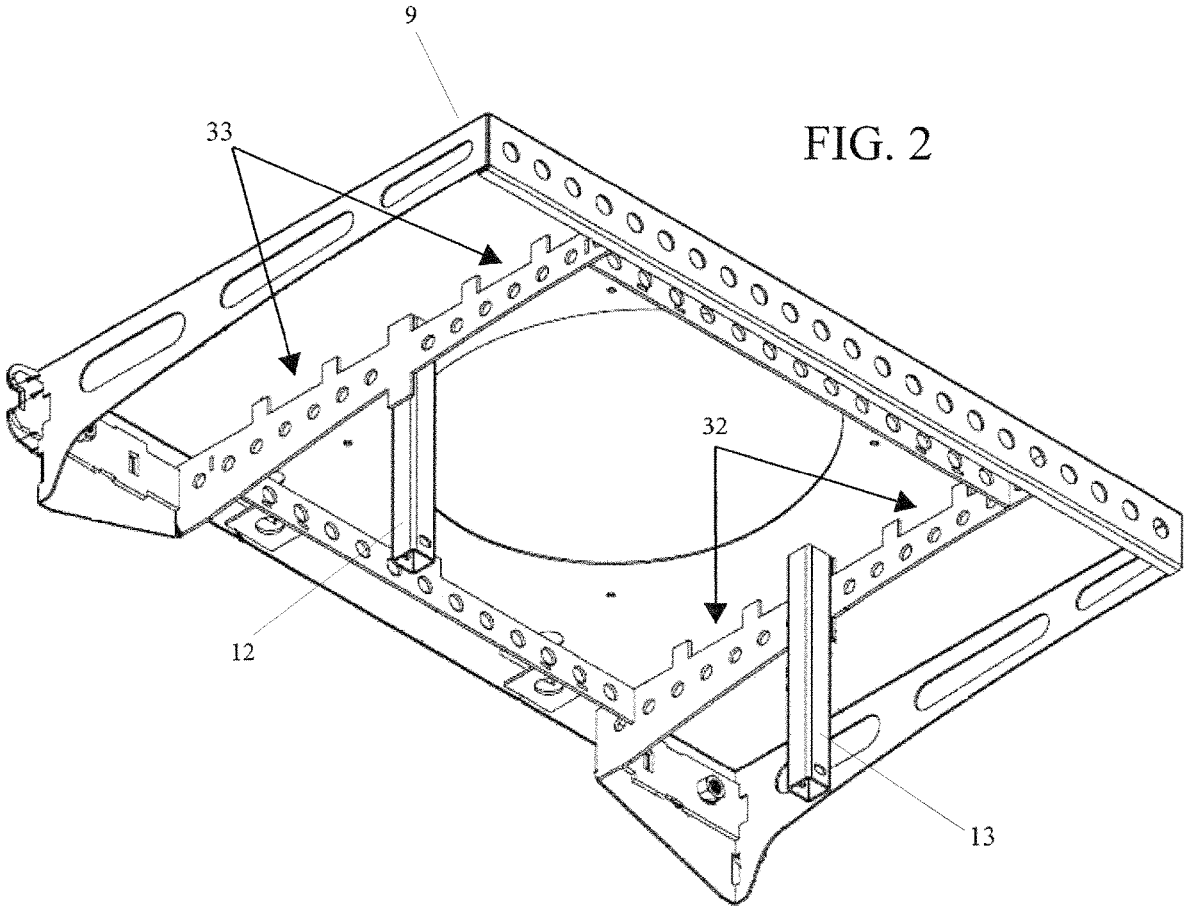
FIG. 2 is a bottom perspective view of a platform of an embodiment of the apparatus having a single platform.
Figure 3A:
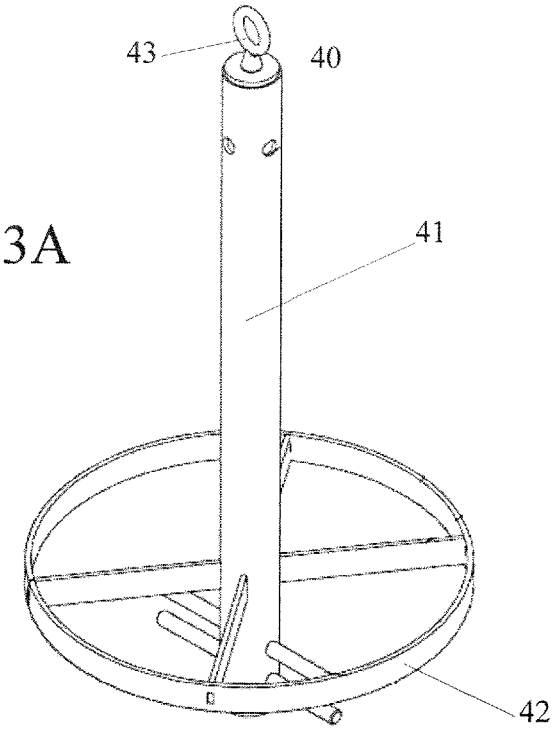
FIG. 3A is a perspective view of a weight holder of an embodiment of the apparatus.
Figure 3B:
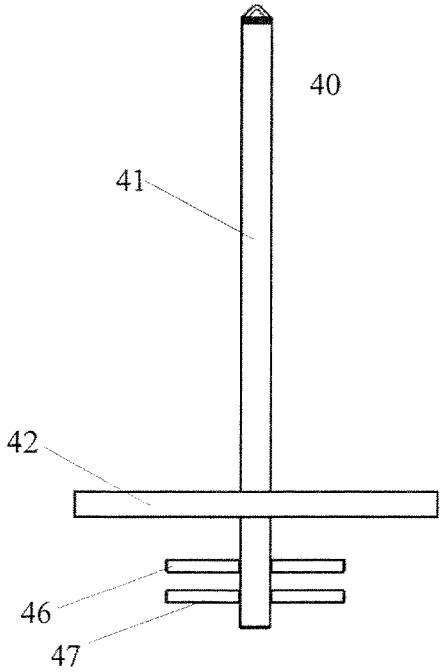
FIG. 3B is a side view of the weight holder of an embodiment of the apparatus of FIG. 3A.
Figure 3C:
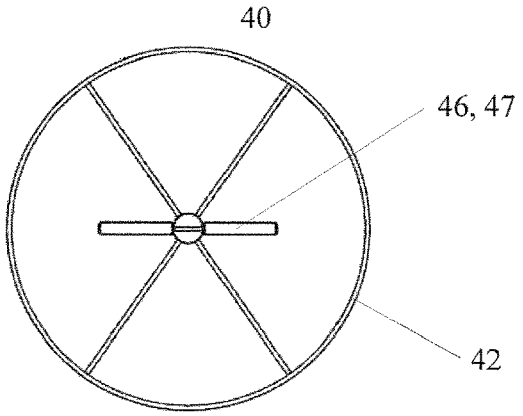
FIG. 3C is a top view of the weight holder of an embodiment of the apparatus of FIG. 3A.
Figure 5B:
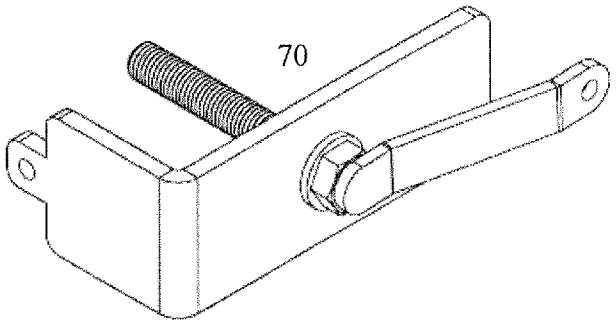
FIG. 5B is a perspective view of the clamp of FIG. 5A.
Figure 5D:
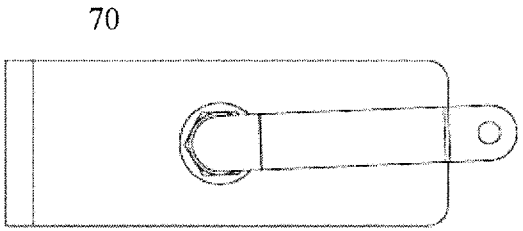
FIG. 5D is a front view of the clamp of FIG. 5A.
Figure 5A:
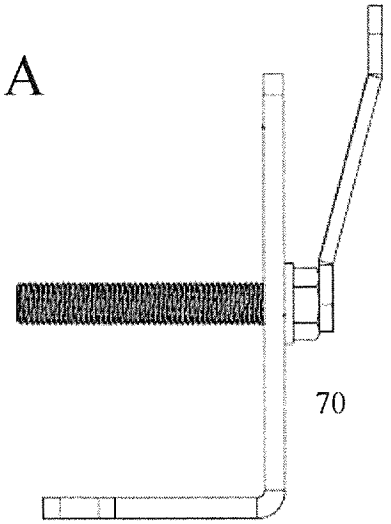
FIG. 5A is a top view of a clamp of an embodiment of the apparatus.
Figure 5C:
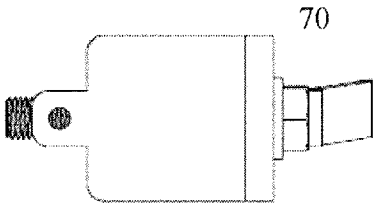
FIG. 5C is a side view of the clamp of FIG. 5A.

Certain embodiments of the present invention will now be described with reference to FIGS. 1A-8C. It should be understood that the invention should not be limited to the structures described or illustrated. In certain embodiments, the weight holder is a hollow tube that is designed to slide over a guide rod located at least partially under the lifter. The guide rod ensures the weight load stays centered with respect to the lifter and limits the horizontal movement (swing) of the weight when it is lifted off the ground by the lifter. However because the weight holder is not fixed to the guide rod but moves relative to the guide rod, the weight load is not "fixed" and therefore remains a "free weight." This is an important distinction from previous exercise apparatuses because free weight exercises are considered superior to weight machines where the weight is fixed. Free weights require more stabilization and allow lifters to get into their natural movement pattern. In other embodiments, the unique weight loader may optionally further include pegs that allow for the weight holder to be connected on both sides to the apparatus by resistance bands. The resistance bands may provide additional limiting of horizontal movement (swing) of the weight when used in combination with the guide rod, and alternatively may replace the guide rod such that the apparatus (otherwise according to any of the embodiments herein) does not include, and exercises may be performed without use of, the guide rod.

As the user performs the squat or deadlift exercise, the guide rod and/or the bands keep the weight load centered. With the design of the apparatuses described herein, the bar and weight load can be placed directly between and under the lifter's legs which eliminates the interference of the barbell that is found in traditional free weight deadlifts. The benefits of the apparatuses described herein over traditional deadlifts with a standard barbell include less shearing load on the lifters spine and create a much less technical lift. As a result, the benefit to risk ratio with the apparatuses is much higher. There is less chance for injury for all athletes both those with or without a compromised spine. Another benefit of the devices described herein is that by removing the technical interference of the barbell, they allow the weight load to be pulled faster off the floor, which is a recognized as a key attribute for team sport athletes who train with weights in order to improve their power and athleticism.

Concerning performance of squat exercises, the apparatuses described herein provides improvements to the exercise equipment disclosed in U.S. Pat. No. 8,961,375 B2. In certain embodiments of the present invention, an improved version of the device disclosed in U.S. Pat. No. 8,961,375 B2 is provided that includes a loading pin that includes pegs (e.g., one or more on opposite sides thereof) connecting to resistance bands that are fixed at the opposite end thereof (e.g., to a platform), as well as an open faced loading pin that allows for the lifter to more easily assess the resistance bands under the platform. Also, unlike other belts that are used for performing belt squats, an improved belt design is adjustable by using daisy chains that allow the lifter to quickly connect to a load at multiple, for example, six, different location loops and/or points that are spaced apart, for example, at every two inches. This allows the belt to be adjustable based on the user's height versus limited to one location of where the user connects to the weight load Embodiments of the present invention may include a standalone platform or one or more platforms or boxes that can be connected to a rack, so that the lifter is elevated and standing above (elevated in relation to) the weight holder.

In one embodiment, the weight holder can also be used as a separate exercise apparatus. It can be used as an exercise sled for pushing and pulling or dragging weight loads. Exercise sleds are widely used by athletes where they are able to push and drag weight loads that are connected via a strap and a belt or harness around the waist of the exerciser. The sled is well known for both its strength building and conditioning capabilities. The weighted loading pin of certain embodiments uses a circular design for holding weight plates, unlike other existing sleds that are square shaped and use parallel skis to slide in a set direction parallel to the skis. The circle sled allows for the sled to be pulled in 360 degrees without having to manually spin around the sled in order for the exerciser to pull the sled in another direction. Also, the weight holder/sled does not require skis and instead includes a base that glides on the ground.

In the embodiment depicted in FIGS. 1A-1D, the exercise apparatus includes an elevated platform 9 with a hole 50; a guide rod 15; a weight holder 40; two movable arms 30, 31 each connected to a loading arm 20, 21 respectively. The hole 50 in the elevated platform is preferably a circular hole, for example, seventeen inches in diameter, positioned in the center of the platform. The hole is so shaped and dimensioned to accept standard thirty-five pound weight plates, each about fourteen inches in diameter. Other embodiments may include a hole of a different size, shape or dimension, or a hole positioned elsewhere in the platform. As will be appreciated by those skilled in the art, the hole 50 may be made smaller in diameter to accommodate users with a narrower stance. Optionally, the hole 50 may have a lip extending upwards (e.g. about an inch) around its perimeter to stabilize the weights, prevent excessive swing and help avoid the user accidently stepping into the hole.

Figure 6A:
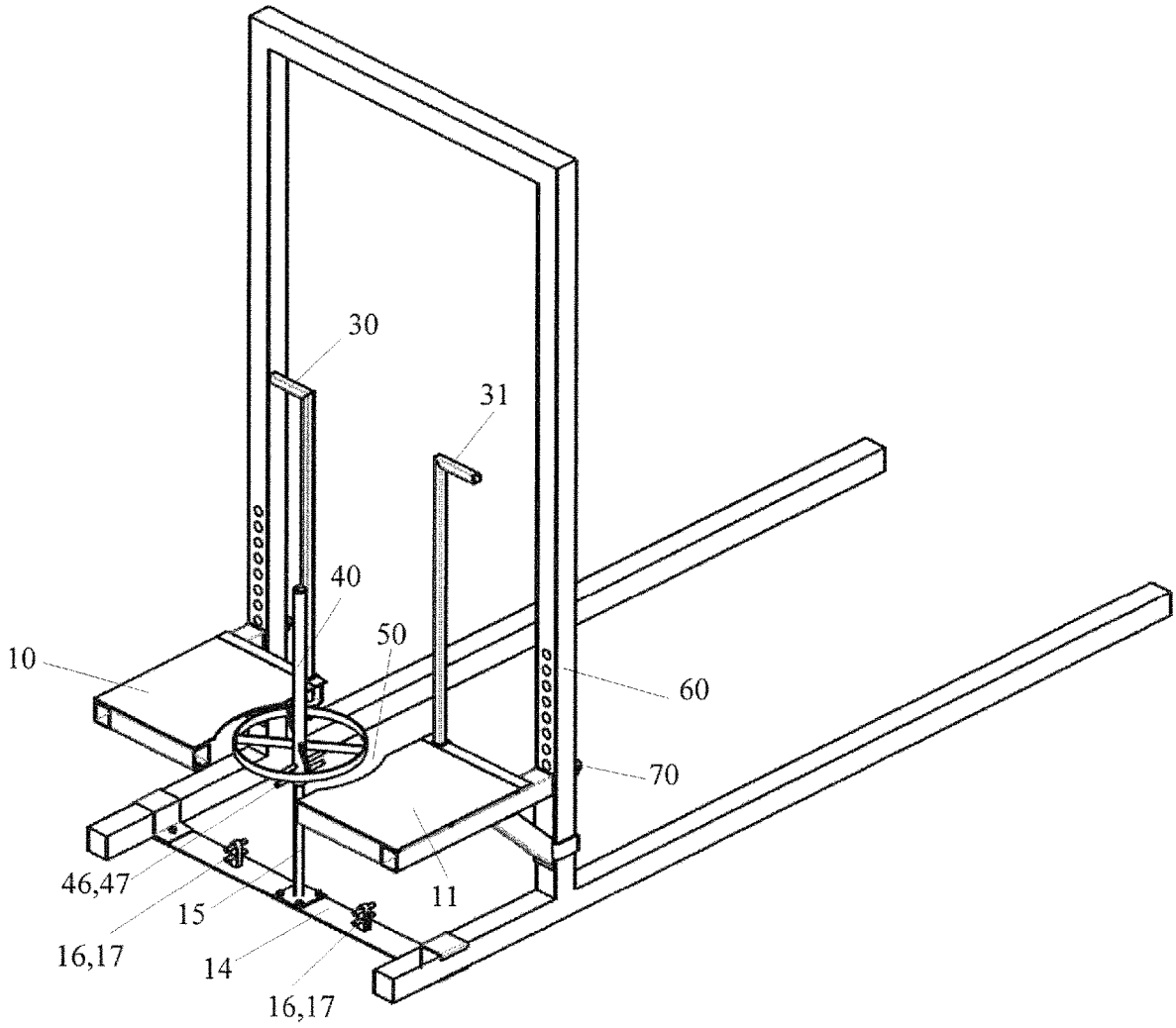
FIG. 6A is a perspective view an embodiment of the apparatus having two platforms after being attached to a rack and with the loading arms in the open exercising position.
Figure 6C:
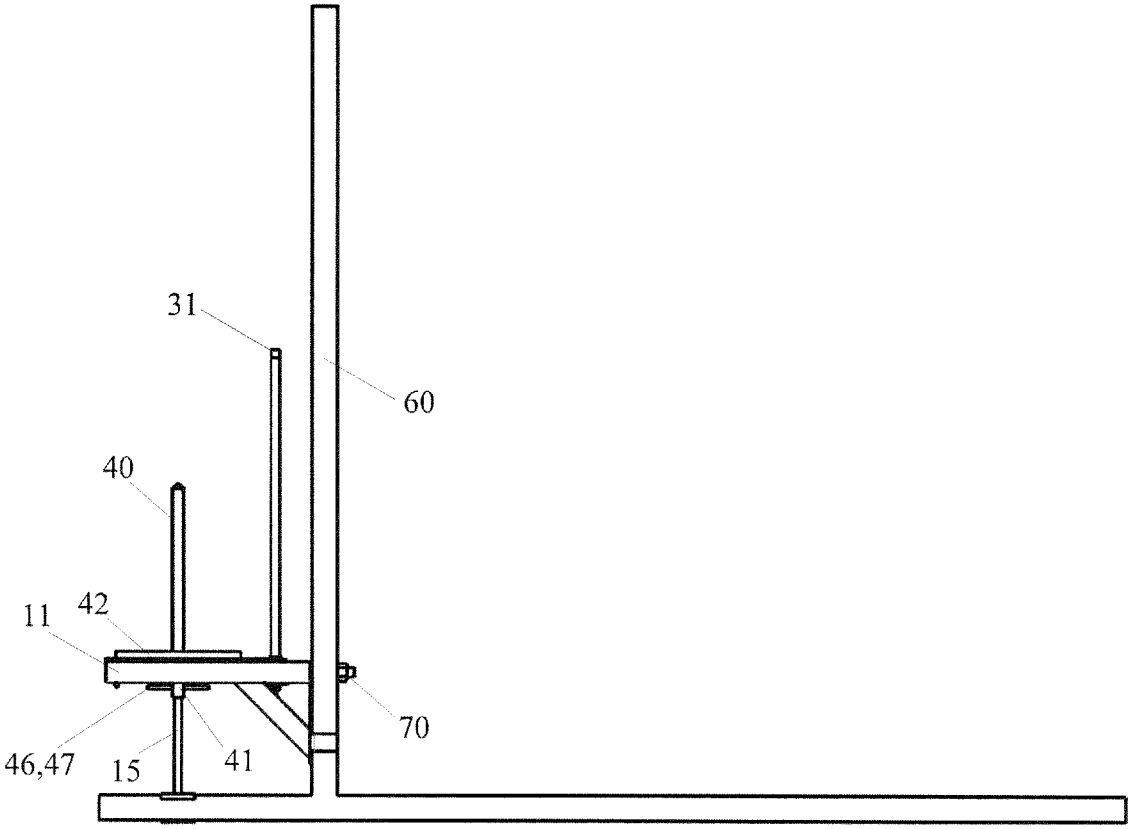
FIG. 6C is a left side view of the embodiment of FIG. 6A.
Figure 6B:
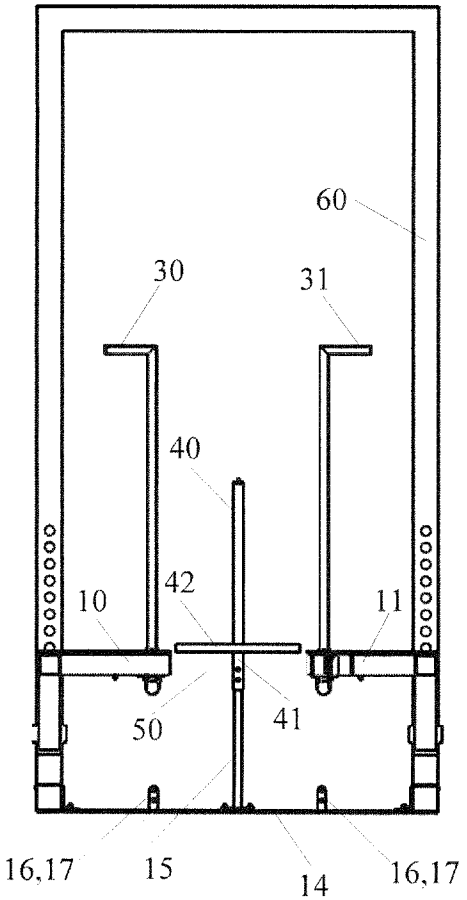
FIG. 6B is a front view of the embodiment of FIG. 6A.
Figure 8A:
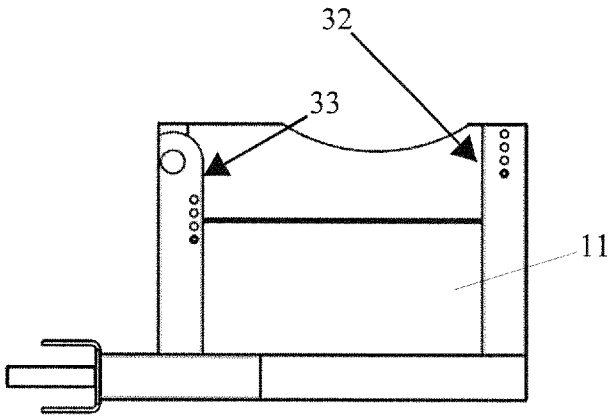
FIG. 8A is a bottom view of a first platform of an embodiment of the apparatus having two platforms.
Figure 8B:
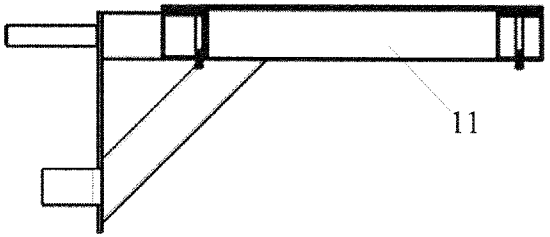
FIG. 8B is a side view of the first platform of FIG. 8A.
Figure 8C:
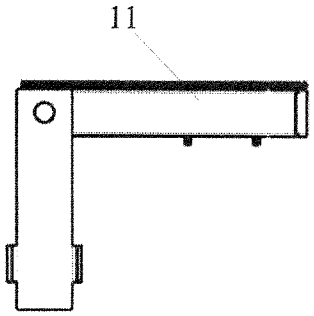
FIG. 8C is a front view of the first platform of FIG. 8A.
Figure 7:
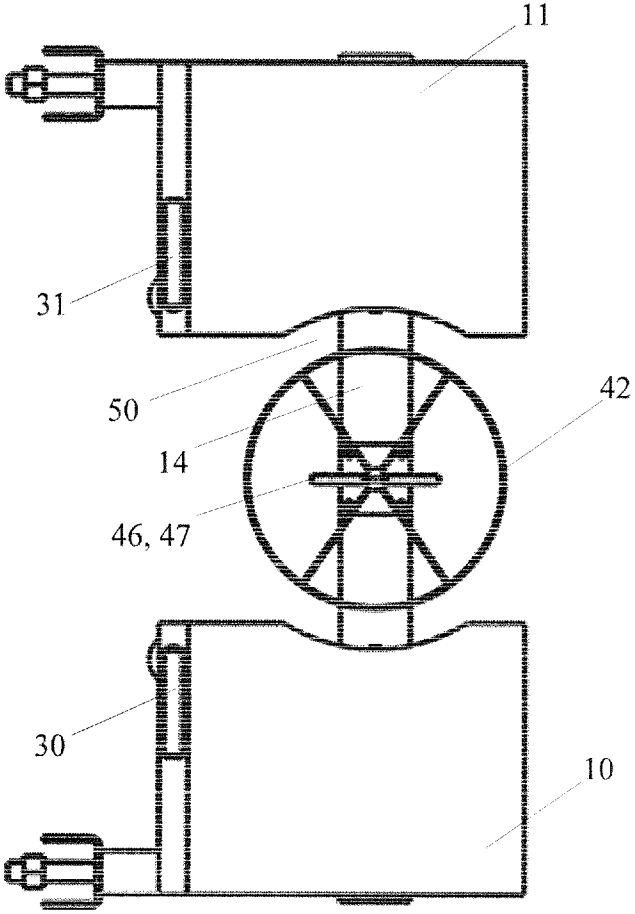
FIG. 7 is a top view of an embodiment of the apparatus having two platforms before being attached to a rack and with the loading arms in the open exercising position.

In the embodiment depicted in FIGS. 6A-6C, the deadlift/squat apparatus includes two elevated standing platforms 10, 11 (sometimes, collectively referred to as a platform) that connect into a standard commercial sold power rack 60 (e.g., a rod/peg on each platform that secure in the existing holes on each side of a power rack, cantilevered, clamps 70, or other means for securing), a guide rod 15, a weight holder 40, two movable arms 30, 31, that connect to loading arms 20, 21 that hold the weight holder 40 for squats.

The platforms 10, 11 are preferably made of steel and in use may connect into the rack at about eighteen inches from the ground (though this height may be user-selected). The guide rod 15 is centered, preferably perfectly, between the standing platforms 10, 11 and aligned with the middle of the hole 50 in and/or between the platforms 10, 11, extending vertically from beneath the platforms 10, 11, preferably to slightly above the platforms 10, 11 (e.g., an inch). Other embodiments may include a guide rod positioned differently with respect to the hole, attached to the apparatus in a different manner and/or a guide rod that does not extend above the level of the platform. Other embodiments may also include a platform of a different shape, dimension, material, elevation height and/or with different structures used for elevation.

In the embodiments of FIGS. 1A-1D and 6A-6C, each movable arm 30, 31 extends down through the platform(s) 9 (10, 11) and connect respectively to loading arms 20, 21 that hold the weight holder 40 which allows a person performing a squat or deadlift to start exercise in a standing position. Preferably, the movable arms 30, 31 are rotatable. Movement, preferably rotation, of the arms 30, 31 control the positions of the loading arms 20, 21, shifting them inward, within the hole 50 where they can support the weight holder 40 to load weights, and outward, outside the hole 50, to cease supporting the weight so that a user may perform the exercise. This allows users to load weights with the weight holder 40 aligned with the hole 50 and centered on the guide rod 15, rather than, e.g., below the platform(s) 9 (10, 11) or on a separate part of the platform(s) 9 (10, 11), which may cause injury. The arms 30, 31 are preferably positioned along an edge of the platforms, in front of the user performing the exercise. Other embodiments may include arms placed in different positions relative to the user, or may omit them.

In the embodiment of FIGS. 1A-1D, the undercarriage of platform 9 includes posts (or legs) 12, 13 that support the platform 9. These posts 12, 13 may connect to a center brace 14 that sits directly under the platform 9. The center brace may have receiving posts 18, 19 that posts 12, 13 fit within, thus aligning the center brace 14 and guide rod 15 (in embodiments including it) with the hole 50. The center brace may anchor the guide rod 15. The posts 12, 13, or the receiving posts 18, 19, also may include attached pegs 16, 17, preferably on both sides, that are used to releaseably attach resistance bands to the posts 12, 13 or receiving posts 18, 19, and releasably connect to the weight holder 40 (e.g., via pegs 46, 47) in order to provide additional resistance and/or to help center the weight either with or without the guide rod. Alternatively, pegs 16, 17 may be attached to the center brace 14 as illustrated in FIGS. 6A and 6B. Furthermore, although not illustrated in FIGS. 6A and 6B, the embodiment therein may similarly include posts (legs) for supporting the platforms (e.g., one post under each platform).

When using the apparatus for squats, the weight holder sits on loading arms 20, 21 which can be released by the lifter using the movable arms 30, 31 that sit above the platform(s) 9 (10, 11) and connect to the loading arms underneath and are turned to release the weight. In alternate embodiments, a single movable arm and/or single loading arm may be used. The loading arms are fastened under the platform(s) 9 (10, 11) with slits 32, 33 that sit in the undercarriage and support the loading arms and also allow them to slide open and closed in order to hold or release the weight holder 40. The slits 32, 33 may have various configurations (i.e., compare FIGS. 1B, 2 and 8A). Certain alternate embodiments include multiple weight holders, each of different weight (i.e., the weight holder is the weight), so that loading and unloading separate weight plates may be unnecessary. In some such embodiments, weight plates may also be loaded for adjusting the desired weight.

The weight holder includes a hollow loading pin 41 that moves on and relative to the guide rod 15 with a base 42, preferably having an open interior, for holding weight plates, preferably Olympic weight plates, and an eyelet or hook which allows for it to releasably connect to equipment, preferably a bar for doing a deadlift exercise and/or a belt for hip belt squats.

The weight holder 40 may also include pegs 46, 47 on at least one side, preferably opposite sides, that are used to attach resistance bands to the weight holder 40 and connect to the platform, preferably to the pegs 16, 17 on the receiving posts 18, 19 (e.g., in FIGS. 1A and 1B) or to pegs 16, 17 on the center brace 14 (e.g., in FIGS. 6A and 6B), in order to provide additional resistance and/or to help center the weight either with or without the guide rod. The hollow loading pin 41 of the weight holder 40 receives and slides vertically over and relative to the guide rod 15, and because the inside diameter of the loading pin 41 is larger than the diameter of the guide rod 15, the loading pin (and thus the weight holder) is also free to move horizontally relative to the guide rod, within a range (e.g., about one inch in any direction, in certain embodiments, though more or less movement may be obtained by changing the relative sizing of the loading pin and guide rod). The loading pin 41 is preferably about two inches in diameter. Other embodiments may include a loading pin of a different diameter, or a set of loading pins of different diameters to give the user varying degrees of freedom of movement. For instance, a wider diameter loading pin on a smaller diameter guide rod would give the user greater freedom of movement to find their natural position with the security of the guide rod to keep the squat from straying too far from the center point. Other embodiments may include a base of a different shape.

As noted above, the weight holder can also be used by itself as a sled exercise for pulling and pushing. The base allows for it to slide across turf and other surfaces. Unique round design allows for athletes to change directions without out manually spinning the sled around to desired direction. It is preferably used with a Nylon hook attached to a nylon pulling belt that slides over the loading arm of the weight loading pin 41 to nylon pulling belt. The nylon hook may be placed on top of an Olympic weight plate and other Olympic plates can be added above it. The nylon hook may have a metal loop that helps allow the nylon hook to move.

In other embodiments, two hand rails are preferably located along the outer sides respectively of the platform(s) 9 (10, 11). The "sides" are relative to the user performing the squat exercise. The handrails are preferably removably affixed to the platforms with removable rail clamps, screws or other attachment means. Other embodiments may include one or more hand railings affixed to the platforms in another manner and/or placed at different positions relative to the platform; for instance, in one embodiment, a single hand rail is placed along one edge of a platform.

Users may perform the desired exercise in the following manner. A user begins by placing the movable arms 30 and 31 in the first, closed or "loading" position, such that the loading arms 20 and 21 are within the hole 50 of the platform(s) 9 (10, 11). The user places the unloaded weight holder 40 onto the loading arms 20 and 21, and aligned with the hole 50. The use may then attach resistance bands to the pegs 16, 17 and the weight holder, preferably also to the pegs 46, 47 on the weight holder. The user then loads weights onto the weight holder 40. Next, the user, wearing a hip belt or using a shorter length bar stands on the platform(s) 9 (10, 11) with feet positioned at either side of the hole 50, preferably facing the movable arms 30 and 31, and hook their hip belt or short bar onto the eyelet or hook 43 of the weight holder 40. Supporting the hip belt or short bar and weight holder 40, the user or an assistant then moves the movable arms 30 and 31 into their second, open "exercising" position, shifting the loading arms 20 and 21 outside the hole and releasing the weight holder 40. The user then beigbeinsto perform the exercise and the weight holder 40 is lowered through the hole 50 and beneath the platform(s) 9 (10, 11) guided by the guide rod 15 and/or resistance bands to prevent excessive horizontal swing. Once the user is in the fully lowered position, he/she stands back up, the guide rod 15 and/or resistance bands again guiding the weights and preventing excessive horizontal swing. When finished with the exercise or set of exercises, the user or their assistant, while in the standing position, may move the movable arms 30 and 31 back into their second, closed position, shifting the loading arms 20, 21 back within the hole 50 to support the weight holder 40. With the weight holder 40 resting on the loading arms 20, 21, the user can disengage the hip belt or short bar from the weight holder 40 and unload the weights from the weight holder 40. Users may similarly perform a deadlift exercise by placing the movable arms 30, 31 into the open exercise position, attaching the shortened bar to the weight holder and lowering the unloaded weight holder to a fully lowered position. The user then loads weights onto the weight holder when in the lowered position, with it supported on the floor, before performing the exercise while standing on the platform(s) 9 (10, 11) with feet positioned at either side of the hole 50, preferably facing the movable arms 30 and 31.

It should be understood that those of ordinary skill in the art will recognize modifications and substitutions may be made to various elements of the present invention. For example, various features and/or elements have been described in connection with the preferred embodiments, which have not been described in another preferred embodiment. It is envisioned that these features and/or elements are interchangeable such that a feature or element described in one embodiment may be used in combination with another embodiment.

Furthermore, it will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the present description, including those of the provisional patent applications referred to herein.

I claim:

1. An exercise apparatus for use with a power rack, the exercise apparatus comprising:

a center brace extending laterally across at least a portion of the exercise apparatus, the center brace having one or more receiving posts extending perpendicularly therefrom;

a guide rod anchored by the center brace and extending perpendicularly from a central point thereon;

a weight holder comprising a hollow loading pin configured to receive and slide vertically over the guide rod, and a base configured to hold one or more weight plates; and at least one platform configured to be releasably secured to the power rack, wherein when a user performs an exercise using the exercise apparatus the weight holder is raised and/or lowered, guided by the guide rod as the weight holder is moved relative to the guide rod and the elevated platform.

2. The exercise apparatus of claim 1, wherein the at least one platform comprises a single platform having a hole positioned in the center thereof to accommodate the weight holder.

3. The exercise apparatus of claim 2, wherein the hole is circular and approximately seventeen inches in diameter.

4. The exercise apparatus of claim 2, wherein the platform includes a lip extending upwards around a perimeter of the hole.

5. The exercise apparatus of claim 1, further comprising at least one movable arm each extending above the at least one platform, each moveable arm coupled to a respective loading arm and configured to rotate inward to support the weight holder to load the weight plates or outward to release the weight holder so that the user may perform the exercise.

6. The exercise apparatus of claim 1, wherein the exercise is a deadlift, and the exercise apparatus further comprises a bar coupled to the weight holder.

7. The exercise apparatus of claim 1, wherein the exercise is a squat, and the exercise apparatus further comprises a weight belt coupled to the weight holder.

8. The exercise apparatus of claim 1, wherein the at least one platform includes at least one leg configured to connect to the center brace via a respective receiving post.

9. The exercise apparatus of claim 1, further comprising one or more clamps configured to secure the at least one platform to the power rack.

10. The exercise apparatus of claim 1, wherein each of the receiving posts of the center brace includes one or more pegs on at least one side thereof for releasably attaching one or more resistance bands thereto.

11. The exercise apparatus of claim 1, wherein a lower end of the hollow loading pin of the weight holder includes one or more pegs on at least one side thereof for releasably attaching one or more resistance bands thereto.

12. The exercise apparatus of claim 1, wherein an upper end of the hollow loading pin of the weight holder includes an opening for releasably connecting to equipment.

13. The exercise apparatus of claim 1, wherein the base of the weight holder has a substantially open interior.

14. The exercise apparatus of claim 1, wherein the at least one platform comprises two platforms having a space therebetween to accommodate the weight holder.

15. The exercise apparatus of claim 1, wherein the at least one platform is made of steel.

16. The exercise apparatus of claim 1, wherein the hollow loading pin is about two inches in diameter.

* * * * *